US005121612A

United States Patent [19]

Guay et al.

[11] Patent Number: 5,121,612

[45] Date of Patent: Jun. 16, 1992

[54] WATER SEPARATOR

[76] Inventors: Etienne Guay, 4848 Fabre, Montreal, Quebec; Robert McNabb, 255, Ile Bélair East, Rosemere, Quebec, both of Canada

[21] Appl. No.: 685,205

[22] Filed: Apr. 15, 1991

[51] Int. Cl.[5] ..... B67D 5/62

[52] U.S. Cl. ..... 62/390; 222/67; 222/146.6

[58] Field of Search ..... 62/390; 222/146.6, 67

[56] References Cited

U.S. PATENT DOCUMENTS

| | | | |
|---|---|---|---|
| 3,698,603 | 10/1972 | Radcliffe | 222/146 R |
| 4,779,426 | 10/1988 | Desrosiers | 62/390 |
| 4,923,091 | 8/1990 | Sutera | 222/67 |
| 4,958,747 | 9/1990 | Sheets | 62/390 |

*Primary Examiner*—Ronald C. Capossela
*Attorney, Agent, or Firm*—ROBIC

[57] ABSTRACT

For separating cooled and uncooled water in a refrigerated bottled drinking water cooler well, a floating receiving reservoir floats in the well and has an upper edge resting on or above a surface of water in the well, the reservoir having an open top surface and being supplied by uncooled water from a mouth of a drinking water bottle turned upside down and submerged in the reservoir. A conduit communicates the reservoir with a first water outlet as the floating reservoir moves up and down in the well. Drawing water from the first outlet causes a level of uncooled water in the reservoir to be lowered until air enters the mouth and water from the bottle is emitted into the receiving reservoir. Drawing water from a second outlet connected to the well causes a level of the surface of water in the well and thus of the uncooled water in the floating reservoir to drop until air enters the mouth and water overfills the receiving reservoir pouring over the upper edge into the well. The separator improves the separate supply of cooled and uncooled water from a refrigerated bottled drinking water cooler.

14 Claims, 3 Drawing Sheets

WATER SEPARATOR

FIELD OF THE INVENTION

The present invention relates to a water separator for separating cooled and uncooled water in a refrigerated bottled drinking water cooler well.

BACKGROUND OF THE INVENTION

In refrigerated bottled drinking water coolers, the known prior art uses a single refrigerated water cooler well which is supplied by water from a water bottle inverted with its neck submerged in the water of the water cooler well. Whenever the level in the well drops below the mouth of the bottle, water is supplied to the well. A supply conduit and spigot is provided to connect water from the lower part of the refrigerated water well and another supply conduit and spigot is provided to supply water in close proximity to the mouth of the bottle. An example of such a water cooler liquid separator is disclosed in U.S. Pat. No. 4,779,426 issued Oct. 25, 1988. A baffle plate between the upper portion of the reservoir wherein the bottled water is received and the lower portion of the reservoir is provided to partially prevent turbulent mixing between the upper part and the lower part of the water cooler well.

In the prior art known, the receiving reservoir is part of the cooling well and will be cooled by the water cooler well in a short period of time whenever there is no flow of water.

The prior art water cooler liquid separator does not provide water at room temperature initially from the room temperature spigot. Instead, the flow must draw room temperature water from the bottle before room temperature water is available. The prior art water cooler liquid separator is inefficient in terms of its use of energy and is inconvenient in that one must wait before the flow of uncooled water from the uncooled water spigot begins to flow.

It is therefore an object of the present invention to provide a water separator for separating cooled and uncooled water in a cooler well which is able to provide a continuous supply of both cooled and uncooled water without wasting any water during the initial supply.

It is furthermore an object of the present invention to provide a refrigerated water cooler well water separator which separates a supply of cooled water from room temperature water from a water bottle which is able to provide initially and continuously a supply of either cooled or uncooled water, which is simple to construct and inexpensive.

SUMMARY OF THE INVENTION

According to the invention, there is provided a water separator for separating cooled and uncooled water in a refrigerated bottled drinking water cooler well, the separator comprising:

a floating receiving reservoir able to float in the well and having an upper edge to rest on or above a surface of water in the well, the floating receiving reservoir being provided with floating means, having an open top surface, and to be supplied by uncooled water from a mouth of a drinking water bottle turned upside down and submerged in the receiving reservoir, and having means to prevent the mouth from sealing with the receiving reservoir; and conduit means for communicating the receiving reservoir with a first outlet as the floating receiving reservoir moves up and down in the well, whereby drawing water from the first outlet causes a level of uncooled water in the receiving reservoir to be lowered until air enters the mouth and water from the bottle is emitted into the receiving reservoir, and drawing water from a second outlet in communication with the well causes a level of the surface of water in the well and thus of the floating receiving reservoir to drop until the level of uncooled water in the receiving reservoir allows air to enter the mouth and water overfills the receiving reservoir pouring over the edge into the well.

BRIEF DESCRIPTION OF THE DRAWINGS

The invention will now be better understood in light of the following detailed description of a preferred embodiment of the invention with reference to the appended drawings, in which.

DETAILED DESCRIPTION OF THE PREFERRED EMBODIMENT

Figure 1:
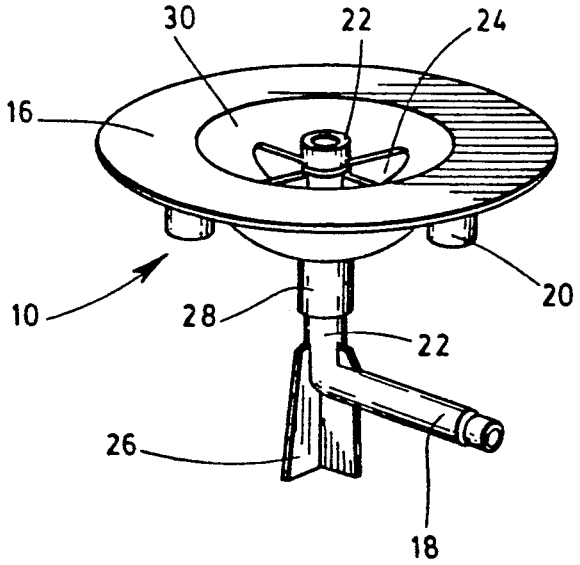
FIG. 1 is a prespective view of the water separator according to the preferred embodiment.

As shown in FIG. 1, the water separator (10) includes a hemispherical receiving reservoir (30) having a flat ringlike upper surface plate (16). Four floatation cups (20) provide air pockets to make the floating reservoir (30) more buoyant. Uncooled water conduit tubes (22) and (18) communicate receiving reservoir (30) to spigot (32). Base (26) supports tube (22) at its lower part. Plate (16) is free to slide up and down on tube (22) by means of a sleeve (28). Four radial ribs (24) prevent the mouth or neck (15) of the water bottle (15) (not shown in FIG. 2) from sealing against the hemispherical wall of reservoir (30).

The plate (16) and reservoir (30) are integrally moulded from plastic and snap fit onto the assembly of communication tube (22) and (18) and base (26), which is also integrally moulded from plastic. Thus, the invention offers a simple and inexpensive two piece, snap fit plastic, hygienic construction that works simply and effectively.

Figure 2:
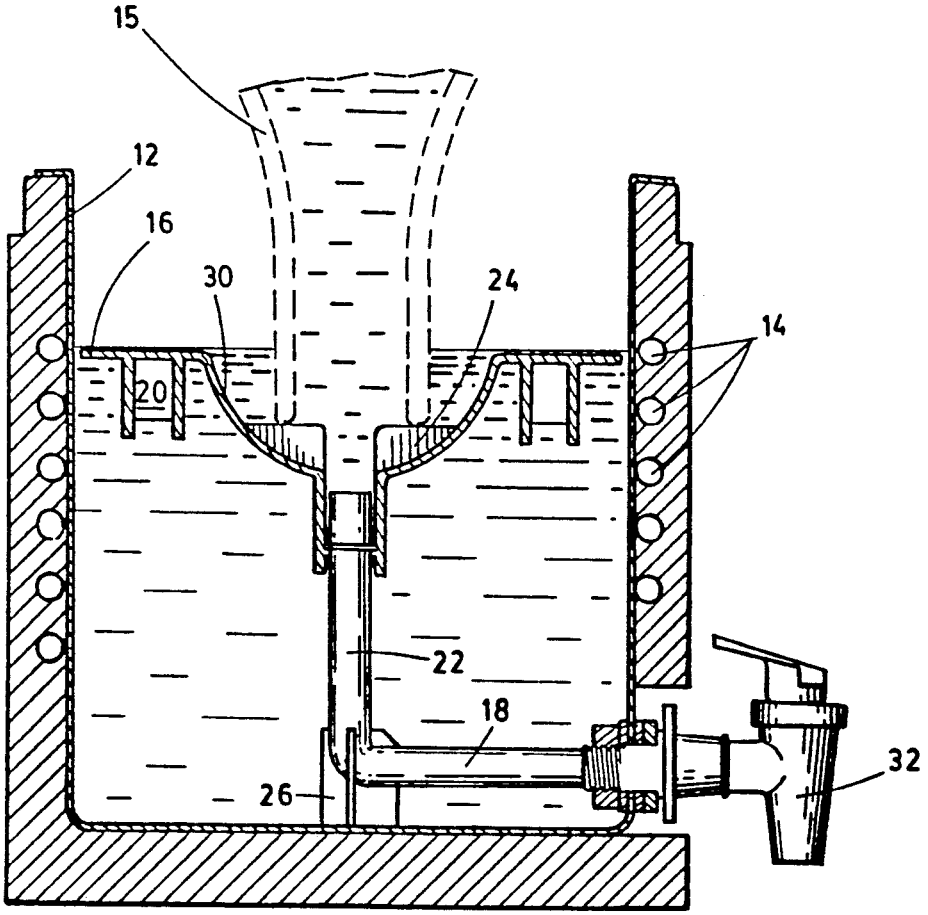
FIG. 2 is a side partially cross-sectional view of a refrigerated water cooler well provided with the water separator according to the preferred embodiment.

As shown in FIG. 2, refrigerated water cooler well (12) has a cylindrical form and is made of metal. Refrigerator expansion coils (14) act as a heat sink to conduct heat away from well (12).

Figure 3:
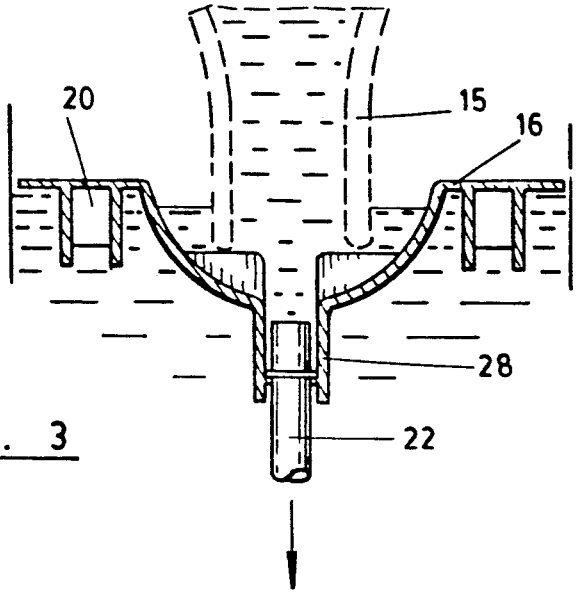
FIG. 3 is a partial side cross-sectional view of the preferred embodiment as water is drawn from the receiving reservoir.

As shown in FIG. 3, when water is drawn through spigot (32) through tube (22), the water level in the receiving reservoir (30) descends below the mouth of neck (15) and air enters therein as a quantity of water resulting from the entry of air fills receiving reservoir (30). In other words, one "glug" of the bottle will fill up but not overfill reservoir (30). Advantageously, the volume of hemispherical reservoir (30) is not much greater than the volume of the quantity of water of one "glug", so that even if water in reservoir (30) becomes chilled, uncooled water is supplied as soon as possible from reservoir (30) to outlet (32).

Figure 4:
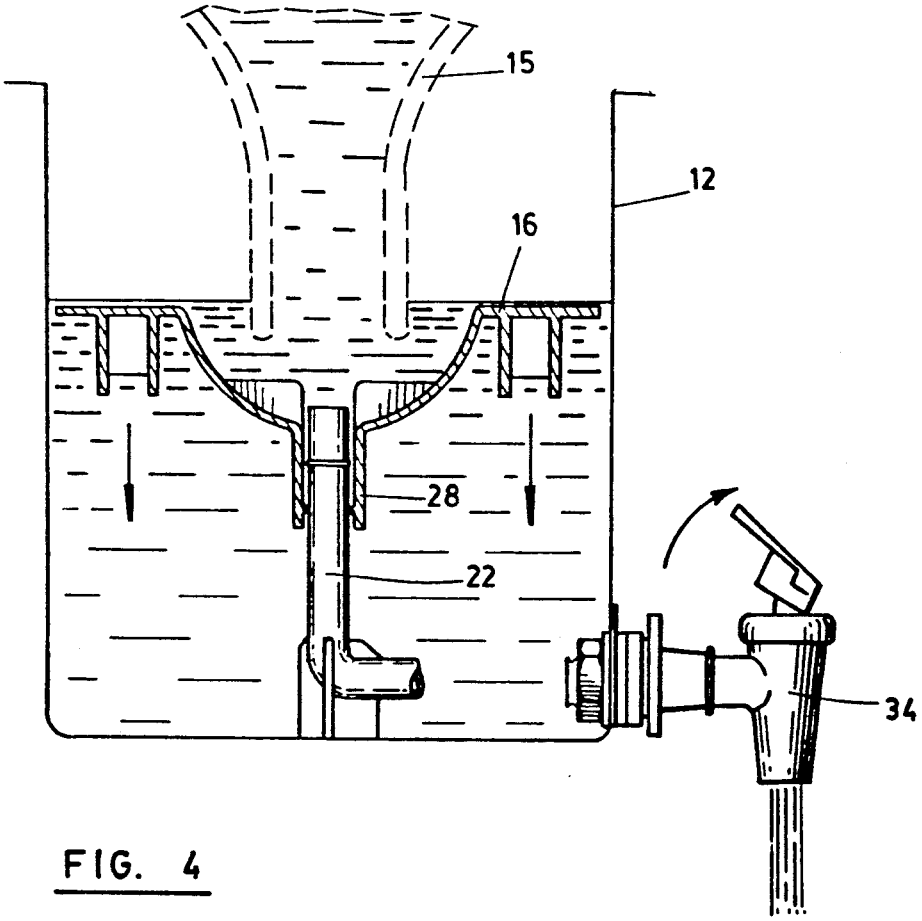
FIG. 4 shows a partially side cross-sectional view of the refrigerated water cooler well wherein water is drawn from the cooler well.
Figure 5:
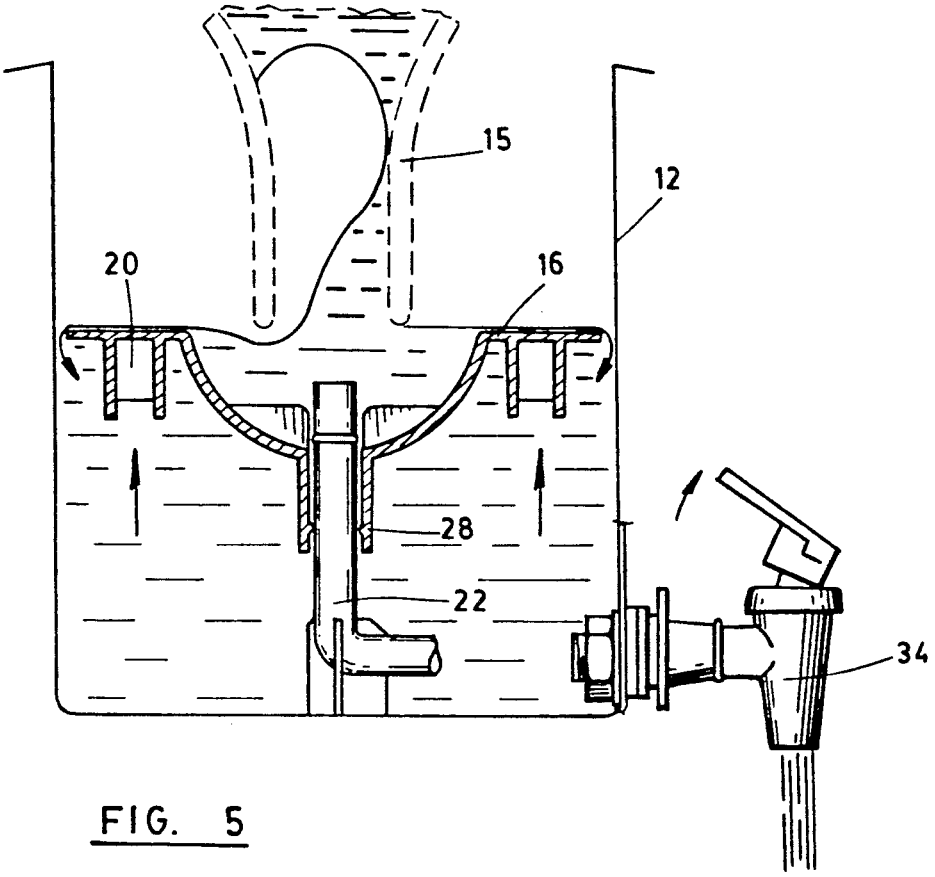
FIG. 5 shows the same view as FIG. 4 wherein the water level drops sufficiently to let water in the mouth of the bottle.

As shown in FIG. 4, when water is dispensed by spigot (34) from the well (12), the water level in the well (12) drops, causing plate (16) and the water level in reservoir (30) to drop together. This will continue until the water level in the receiving reservoir (30) drops below the neck (15) of the water bottle as shown in FIG. 5. When this happens, water will pour out over plate (16) and down into reservoir (12) by the side of plate (16).

Figure 6:
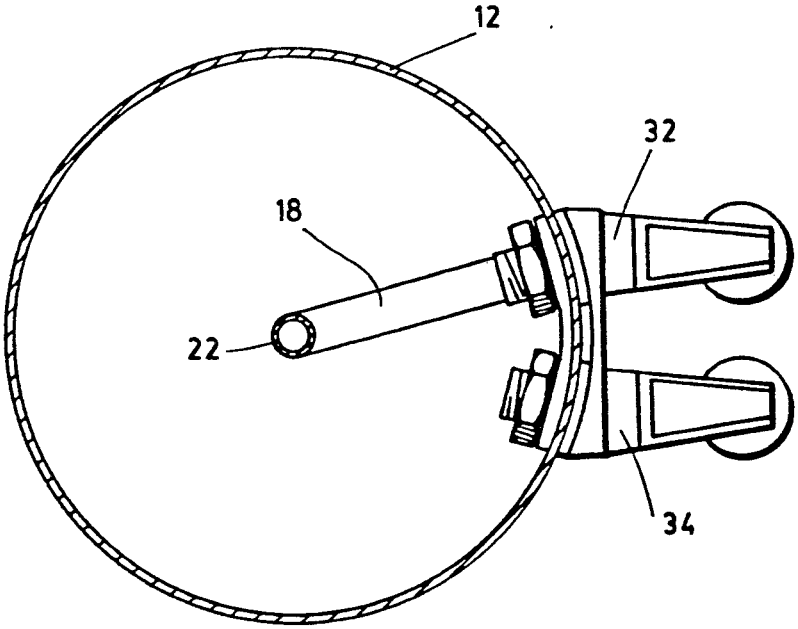
FIG. 6 shows a top view of the water cooler well showing the pair of parallel spigots providing the outlets for the cooled and uncooled water.

As shown in FIG. 6, spigots (32) and (34) are provided parallel side by side at an angle with respect to the cylindrical side surface of well (12). The spigots are connected with respect to one another by means of a flexible curved plastic connector which orients spigots (32) and (34) with respect to one another. The configuration of spigots (32) and (34) has the advantage that the connection is direct to the water well (12) from the side and not below the water well (12), which avoids providing the spigots at a lower level below well (12).

Although the floating means used to keep the receiving reservoir (30) floating in well (12) have been illustrated as comprising floatation cups (20), it is of course possible for the receiving reservoir (30) to be kept afloat by other means which can provide the necessary buoyant force to keep reservoir (30) and plate (16) afloat. For example, reservoir (30) and plate (16) could be made from a material which is buoyant and itself has sufficient buoyancy to keep reservoir (30) and plate (16) afloat.

In the preferred embodiment, the means to prevent the mouth of bottle (15) from sealing with the bottom of hemispherical reservoir (30) have been illustrated as ribs (24). Clearly, any object interfering with a sealing contact between the mouth of bottle (15) and reservoir (30) can be implemented such as, for example, grooves provided in reservoir (30). Furthermore, the means to prevent the mouth from sealing against the walls of reservoir (30) may be intrinsically formed either by a reservoir (30) of a shape incapable of making sealing contact with the mouth of bottle (15) or by providing a reservoir (30) of sufficient depth such that the bottom of reservoir (30) would never make contact with bottle (15).

Although the conduit means have been shown as plastic tubes (22) and (18) fitting into a sleeve (28) in a sliding fashion, the conduit means can also comprise other tubing or hose passage ways which allow fluid to be communicated from reservoir (30) as it floats in well (12), such as a flexible hose or a resilient accordeon-type tube.

It is to be understood that the above description of the preferred embodiment of the invention is not intended to limit the scope of the present invention as defined in the appended claims.

We claim:

1. A water separator for separating cooled and uncooled water in a refrigerated bottled drinking water cooler well, the separator comprising:

a floating receiving reservoir able to float in said well and having an upper edge to rest on or above a surface of water in said well, the floating receiving reservoir being provided with floating means, having an open top surface, and to be supplied by uncooled water from a mouth of a drinking water bottle turned upside down and submerged in the receiving reservoir, and having means to prevent said mouth from sealing with the receiving reservoir; and conduit means for communicating the receiving reservoir with a first outlet as the floating receiving reservoir moves up and down in said well, whereby drawing water from the first outlet causes a level of uncooled water in the receiving reservoir to be lowered until air enters said mouth and water from the bottle is emitted into the receiving reservoir, and drawing water from a second outlet in communication with said well causes a level of the surface of water in said well and thus of the uncooled water in the floating receiving reservoir to drop until air enters said mouth and water overfills the receiving reservoir pouring over said edge into said well.

2. The water separator as claimed in claim 1, wherein said upper edge includes a flat annular plate, and the flat plate rests on said surface of water in said well.

3. The water separator as claimed in claim 2, wherein said flat plate is round.

4. The water separator as claimed in claim 3, wherein the floating means comprise a plurality of inverted cup-shaped members providing air pockets, said members being located evenly around an underside of said flat plate.

5. The water separator as claimed in claim 3, wherein the floating receiving reservoir is hemispherically-shaped, and the means to prevent said mouth from sealing with the receiving reservoir comprise a number of radially disposed ribs provided inside the receiving reservoir, which prevent said mouth from making sealing contact with a side wall of the receiving reservoir.

6. The water separator as claimed in claim 5, wherein a partial volume of the receiving reservoir between a level at which air enters said mouth and a level near said upper edge is greater than the amount of water emitted by said bottle as one bubble of air enters said mouth, causing a quantity of water to be emitted form said mouth.

7. The water separator as claimed in claim 5, wherein said plate covers most of the surface of water in said well, said well having a circular horizontal cross-section.

8. The water separator as claimed in claim 7, wherein said conduit means comprise a sleeve provided at a bottom of the floating receiving reservoir, a vertical tube slidable in said sleeve, and a horizontal tube connecting the vertical tube to the first outlet.

9. The water separator as claimed in claim 8, wherein the conduit means further comprise a base connected to the vertical and horizontal tubes, the base to be supported by a bottom of said well.

10. The water separator as claimed in claim 1, wherein said conduit means comprise a sleeve provided at a bottom of the floating receiving reservoir, a vertical tube slidable in said sleeve, and a horizontal tube connecting the vertical tube to the first outlet.

11. The water separator as claimed in claim 10, wherein the conduit means further comprise a base connected to the vertical and horizontal tubes, the base to be supported by a bottom of said well.

12. The water separator as claimed in claim 1, wherein the floating means comprise a plurality of inverted cup-shaped members connected to said floating receiving reservoir.

13. The water separator as claimed in claim 1, wherein a partial volume of the receiving reservoir between a level at which air enters said mouth and a level near said upper edge is greater than the amount of water emitted by said bottle as one bubble of air enters said mouth, causing a quantity of water to be emitted from said mouth.

14. The water separator as claimed in claim 1, wherein the floating receiving reservoir is hemispherically-shaped, and the means to prevent said mouth from sealing with the receiving reservoir comprise a number of radially disposed ribs provided inside the receiving reservoir, which prevent said mouth from making sealing contact with a side wall of the receiving reservoir.

* * * * *